US011640121B2

(12) United States Patent
Uchihashi

(10) Patent No.: US 11,640,121 B2
(45) Date of Patent: May 2, 2023

(54) CARRIER FOR DEVELOPER AND DEVELOPER

(71) Applicant: KYOCERA Document Solutions Inc., Osaka (JP)

(72) Inventor: Yuma Uchihashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 290 days.

(21) Appl. No.: 17/175,766

(22) Filed: Feb. 15, 2021

(65) Prior Publication Data

US 2021/0263438 A1 Aug. 26, 2021

(30) Foreign Application Priority Data

Feb. 20, 2020 (JP) ..... JP2020-027236

(51) Int. Cl.
*G03G 9/113* (2006.01)
*G03G 9/097* (2006.01)

(52) U.S. Cl.
CPC ..... *G03G 9/1136* (2013.01); *G03G 9/09775* (2013.01); *G03G 9/1131* (2013.01)

(58) Field of Classification Search
CPC ..... G03G 9/113; G03G 9/1131
See application file for complete search history.

(56) References Cited

U.S. PATENT DOCUMENTS

2006/0121386 A1* 6/2006 Kamikoriyama .. G03G 9/10884 430/111.35

FOREIGN PATENT DOCUMENTS

| | | | | |
|---|---|---|---|---|
| JP | H10-186730 | * | 7/1998 | ..... G03G 9/113 |
| JP | H10-232514 | | 9/1998 | |
| WO | WO 2017175646 | * | 10/2017 | ..... G03G 9/1136 |

OTHER PUBLICATIONS

Translation of WO 2017175646.*
Translation of JP H10-186730.*

* cited by examiner

*Primary Examiner* — Peter L Vajda
(74) *Attorney, Agent, or Firm* — Lex IP Meister, PLLC

(57) ABSTRACT

A carrier for a developer includes carrier particles. The carrier particles have a sea island structure including a sea portion and an island portion on the surface. The island portion contains a nitrogen-containing silicone resin. The sea portion contains a nitrogen-free silicone resin. The area ratio of the island portion in the total area of the surface of the carrier particle is 20% or more and 40% or less.

6 Claims, 7 Drawing Sheets

CARRIER FOR DEVELOPER AND DEVELOPER

This application is based on and claims the benefit of priority from Japanese Patent application No. 2020-027236 filed on Feb. 20, 2020, which is incorporated by reference in its entirety.

BACKGROUND

The present disclosure relates to a carrier for a developer and to a developer.

When an image is formed using an image forming apparatus such as a printer, an electrostatic latent image is developed using a developer. The developer includes, for example, a toner and a carrier. The toner is friction charged by the carrier. The friction charged toner is used to develop an electrostatic latent image. For example, in a certain carrier, a resin coat layer is provided on a core material. The resin coat layer contains a resin containing an NCO group and an acrylic resin containing a fluorine atom.

SUMMARY

A carrier for a developer according to the present disclosure includes carrier particles. The carrier particles have a sea island structure including a sea portion and an island portion on the surface thereof. The island portion contains a nitrogen-containing silicone resin. The sea portion contains a nitrogen-free silicone resin. An area ratio of the island portion in a total area of the surface of the carrier particle is 20% or more and 40% or less.

A developer according to the present disclosure contains a positively chargeable toner including toner particles and the carrier for a developer.

DETAILED DESCRIPTION

Figure 1:
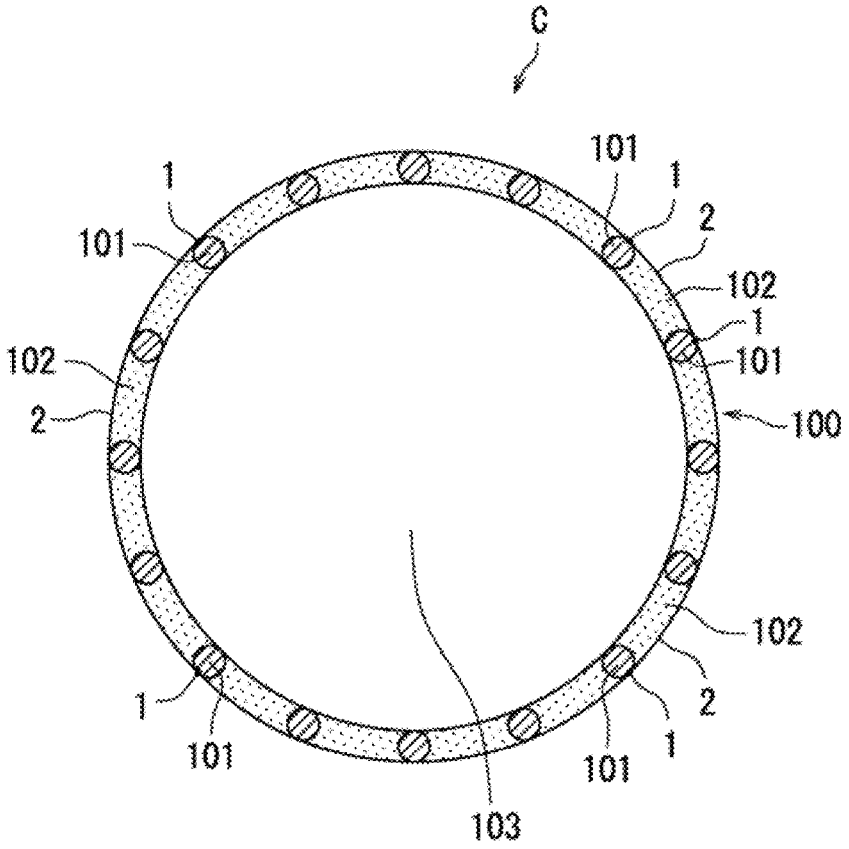
FIG. 1 is a view showing a cross section of a carrier particle contained in a carrier according to a first embodiment of the present disclosure.

First, the meanings of terms and measurement methods used in this specification will be described. The carrier is a collection of carrier particles, and the toner is a collection of toner particles. Unless otherwise specified, an evaluation result (a value indicating a shape, a physical property, or the like) regarding a powder (more specifically, a toner mother particle, an external additive, a toner particle, a carrier core, a carrier particle, or the like) is a number average of values measured for a substantial number of particles included in the powder.

The particle size and the number-average particle size of a powder are, unless otherwise specified, the number-average value of the equivalent circle diameter of the primary particle (Heywood diameter: the diameter of a circle having the same area as the projected area of the particle) measured with a microscope.

The volume median diameter ($D_{50}$) of the powder is a value measured based on the Coulter principle (pore resistance method) by using a "Coulter Counter Multisizer 3" manufactured by Beckman Coulter Co., Ltd. Hereinafter, "volume median diameter" may be described as "$D_{50}$".

Unless otherwise specified, the glass transition temperature (Tg) is a value measured according to JIS (Japan Industrial Standards) K7121-2012 using a differential scanning calorimeter ("DSC-6220" manufactured by Seiko Instruments Co., Ltd.). In an endothermic curve of a sample measured by a differential scanning calorimeter (vertical axis: heat flow (DSC signal), horizontal axis: temperature), the temperature at the inflection point caused by glass transition corresponds to the glass transition point. The temperature at the inflection point due to glass transition is specifically the temperature at the intersection of the extrapolated line of the baseline and the extrapolated line of the falling line. Hereinafter, "glass transition point" may be referred to as "Tg".

The measured value of the melting point (Mp), unless otherwise specified, is the temperature of the maximum endothermic peak in the endothermic curve (vertical axis: heat flow (DSC signal), horizontal axis: temperature) measured using a differential scanning calorimeter ("DSC-6220" manufactured by Seiko Instruments Co., Ltd.). Hereinafter, "melting point" may be described as "Mp".

Unless otherwise specified, each measured value of the weight average molecular weight (Mw) is a value measured by gel permeation chromatography. Hereinafter, "weight average molecular weight" may be described as "Mw".

Unless otherwise specified, each material described in the embodiments of the present disclosure may use only one kind, or may be used in combination of two or more kinds. Also, "each independently" used in the description of the general formula means "each is the same or different". Also, there are cases where a "based" is added after a compound name to collectively refer to a compound and its derivatives. Also, when a "based" is added after a compound name to indicate a polymer name, it means that the repeating unit of the polymer is derived from the compound or its derivatives. The meanings of the terms used in the present specification and the measurement method have been explained. Next, an embodiment of the present disclosure will be explained.

First Embodiment: Developer Carrier

Figure 2:
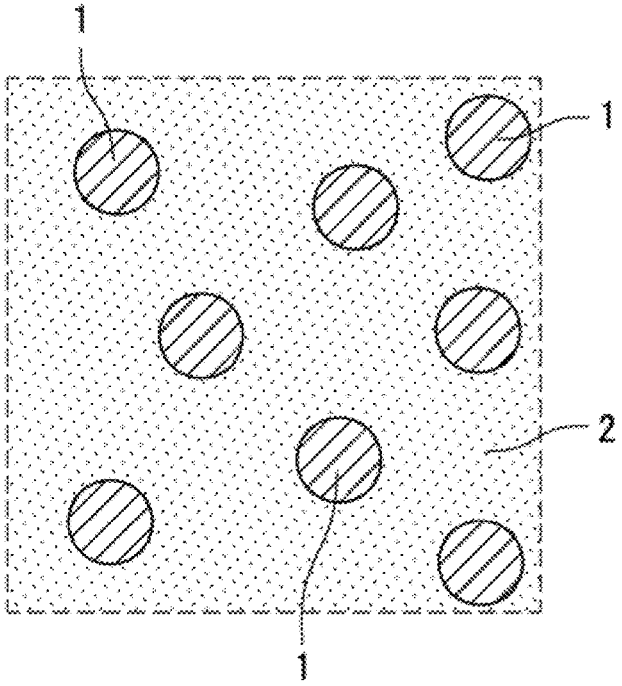
FIG. 2 is a view showing the surface of the carrier particles contained in the carrier according to the first embodiment of the present disclosure.
Figure 3:
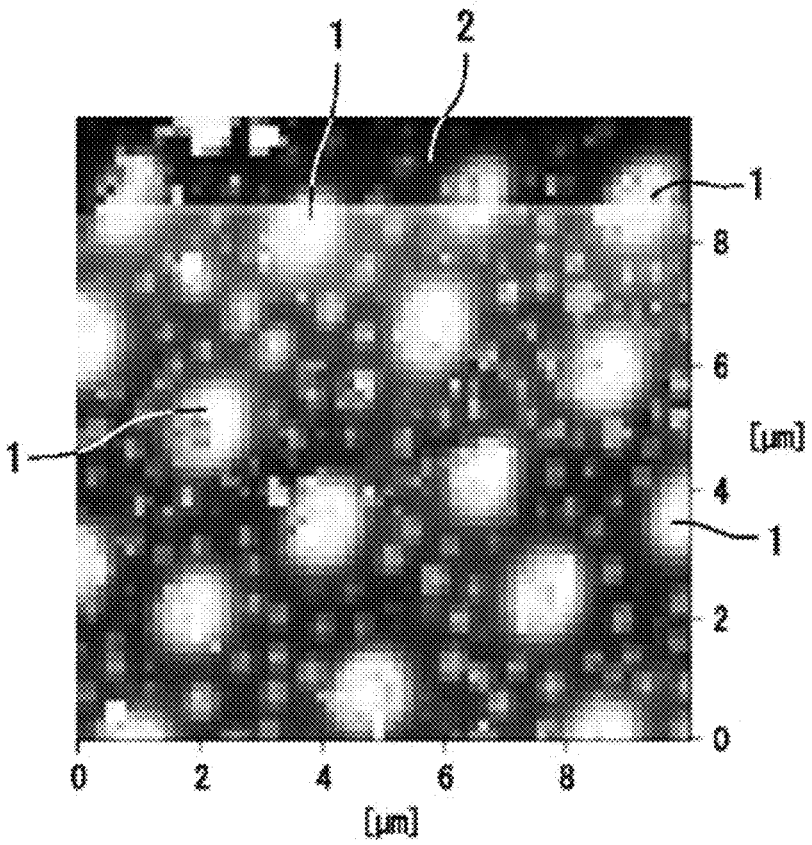
FIG. 3 is a photograph showing a potential image of the surface of the carrier particle contained in the carrier according to the first embodiment of the present disclosure by a scanning probe microscope.

Referring to FIGS. 1 to 3, a developer carrier according to a first embodiment of the present disclosure (hereinafter, sometimes referred to as a carrier) will be described. FIG. 1 is a diagram showing a cross section of a carrier particle C contained in the carrier according to the first embodiment. FIG. 2 is a view showing the surface of the carrier particles C contained in the carrier according to the first embodiment. FIG. 3 is a potential image of the surface of the carrier particles C contained in the carrier according to the first embodiment, measured by the Kelvin Force Microscope (KFM) mode of a scanning probe microscope.

The carrier according to the first embodiment includes carrier particles C. As shown in FIG. 1, the carrier particles C have a carrier core 103 and a coat layer 100. The coat layer 100 covers the carrier core 103. The coat layer 100 has first resin particles 101 and second resin regions 102 in the layer. The first resin particle 101 contains a nitrogen-containing silicone resin. The second resin region 102 contains a nitrogen free silicone resin. In the coat layer 100, the first resin particles 101 are dispersed in the nitrogen-free silicone resin constituting the second resin region 102. The thickness of the second resin region 102 of the coat layer 100 is preferably equal to or less than the diameter of the first resin particle 101, and more preferably equal to the diameter of the first resin particle 101.

Since the carrier particles C have the sectional structure shown in FIG. 1, the carrier particles C have the surface structure shown in FIG. 2. As shown in FIG. 2, the carrier particles C have the sea island structure on the surface. The sea island structure includes a sea portion 2 and an island portion 1. The island portion 1 is a portion of the first resin particle 101 exposed on the surface of the carrier particle C. Since the first resin particles 101 contain a nitrogen-containing silicone resin, the island portion 1 contains a nitrogen-containing silicone resin. The sea portion 2 is a portion of the second resin region 102 exposed on the surface of the carrier particles C. Since the second resin region 102 contains a nitrogen-free silicone resin, the sea portion 2 contains a nitrogen-free silicone resin. The sea portion 2 is a region that spreads continuously on the surface of the carrier particle C, and the island portion 1 is a region that is discontinuously scattered on the surface of the carrier particle C. The island portions 1 are preferably scattered on the surface of the carrier particles C, and more preferably are scattered uniformly.

When the surface of the carrier particles C is measured by the KFM mode of a scanning probe microscope equipped with a probe (for example, a rhodium coated probe), a potential image as shown in FIG. 3 is observed. The unit of the scale in FIG. 3 is μm. In the potential image of the surface of the carrier particles C, the distribution of the surface potential is confirmed. Specifically, in this potential image, a region in which the absolute value of the surface potential is high (a white region in FIG. 3, a region corresponding to the first region $A_1$ described later in the example) and a region in which the absolute value of the surface potential is low (a black region in FIG. 3, a region corresponding to the second region $A_2$ described later in the embodiment) are confirmed. The area where the absolute value of the surface potential is high is the island portion 1, and the area where the absolute value of the surface potential is low is the sea portion 2.

The carrier of the first embodiment is used, for example, with a positively chargeable toner (hereinafter referred to as toner). Since the carrier particle C has a sea island structure on its surface, the island portion 1 contains a nitrogen-containing silicone resin, and the sea portion 2 contains a nitrogen-free silicone resin, the following advantages are obtained. That is the island portion 1 has an electron-donating property and tends to be positively charged. For this reason, the island portion 1 electrostatically collects toner that has not been properly charged (for example, negatively charged toner or toner whose positive charge amount has fallen below a desired value) in the developing device 11 (see FIG. 6). For example, when the image forming apparatus 20 (see FIG. 5) adopts the trickle developing method, the new developer D (see FIG. 6) is supplied from the developer supply unit 115 (see FIG. 6), so that the developer D is discharged from the developing device 11 (see FIG. 6). The discharged developer D contains carriers that have collected the toner of charging failure. In this way, the toner of charging failure is discharged with the developer D, so that the toner of charging failure does not remain in the developing device 11 for a long time. As a result, it is possible to suppress the fogging that occurs in the formed image caused by the toner of charging failure. The trickle development method will be described later in the third embodiment.

As described above, the island portion 1 contains a nitrogen-containing silicone resin, and the sea portion 2 contains a nitrogen-free silicone resin. Since the silicone resin contained in the island portion 1 contains nitrogen atoms, and the silicone resin contained in the sea portion 2 does not contain nitrogen atoms, the island portion 1 can appropriately collect the toner that has been insufficiently charged. In addition, since both the first resin particle 101 constituting the island portion 1 and the second resin region 102 constituting the sea portion 2 contain a silicone resin, the dispersibility of the materials (a nitrogen containing silicone resin and a nitrogen-free silicone resin) in the coat layer 100 is improved. Therefore, the first resin particles 101 are evenly dispersed in the coat layer 100, and the island portions 1 can be evenly scattered on the surface of the carrier particles C. When the coat layer 100 is cured by heating, the silanol groups of the nitrogen containing silicone resin react with the silanol groups of the nitrogen free silicone resin at the interface between the first resin particles 101 constituting the island portion 1 and the second resin region 102 constituting the sea portion 2 to form a covalent bond (for example, —Si—O—Si-bond). As a result, detachment of the first resin particles 101 from the coat layer 100 can be suppressed.

The area ratio of the island portion 1 in the total area of the surface of the carrier particle C is 20% or more and 40% or less. Hereinafter, the area ratio of the island portion 1 in the total area of the surface of the carrier particle C may be abbreviated as the area ratio of the island portion 1. When the area ratio of the island portion 1 is 20% or more, the area of the island portion 1 becomes moderately large, and the island portion 1 can collect the toner of charging failure suitably. As a result, fogging occurring in the formed image is suppressed. On the other hand. When the area ratio of the island portion 1 is 40% or less, the area of the sea portion 2 can be sufficiently secured, and the toner can be friction charged to a desired value by friction with the sea portion 2. As a result, fogging occurring in the formed image is suppressed.

In order to suppress fogging occurring in the formed image, the area ratio of the island portions 1 is preferably 25% or more and 35% or less.

The area ratio of the island portion 1 can he measured, for example, by observing the surface of the carrier particles C by the KFM mode of a scanning probe microscope equipped with a probe (for example, a probe coated with rhodium), obtaining a potential image, and performing image analysis on the obtained potential image. The method of measuring the area ratio of the island portion 1 will be described later in detail in Examples.

The area ratio of the island portions 1 can be adjusted, for example, by changing the ratio of the amount of the first resin particles 101 to the amount of the nitrogen-free silicone resin that constitutes the second resin region 102 when forming the coat layer 100. As the ratio of the addition amount of the first resin particles 101 to the addition amount of the nitrogen-free silicone resin constituting the second resin region 102 increases, the area ratio of the island portion 1 increases.

In order to adjust the area ratio of the island portions 1 within a desired range, the mass of the nitrogen-containing silicone resin contained in the first resin particle 101 is preferably 25 parts by mass or more and 70 parts by mass or less relative to 100 parts by mass of the nitrogen-free silicone resin contained in the second resin region 102. In order to adjust the area ratio of the island portion 1 within a desired range, the content of the nitrogen-containing silicone resin relative to 100 parts by mass of the nitrogen-free silicone resin is preferably within a range of two values selected from the group consisting of 25 parts by mass, 30 parts by mass, 43 parts by mass, 50 parts by mass, 67 parts by mass, and 70 parts by mass.

The average surface potential Vi of the island portion 1 and the average surface potential $V_2$ of the sea portion 2 preferably satisfy the following formula (A). $|V_1-V_2|$ in formula (A) is an absolute value of a value calculated from the formula "$V_1-V_2$". Hereinafter, a value calculated from "$|V_1-V_2|$" in formula (A) may be described as a surface potential difference ΔV.

$$|V_1-V_2| \geq 0.8\ \text{V} \quad \text{(A)}$$

The upper limit of the surface potential difference ΔV is not particularly limited, but the surface potential difference ΔV is, for example, 2.0 V or less. The surface potential of the island portion 1 and the surface potential of the sea portion 2 are potentials generated by contact between a probe (for example, a probe coated with rhodium) provided in a scanning probe microscope and the surface of the carrier particle C, and are determined by the difference in work function between the surface of the carrier particle C and the probe. Therefore, the surface potential of the island portion 1 and the surface potential of the sea portion 2 are different from the potential generated by frictional electrification between the surfaces of the toner particles T and the carrier particles C at the time of development. Therefore, even when a carrier is used with toner (i. e., positively chargeable toner), the average surface potential $V_1$ of the island portion 1 and the average surface potential $V_2$ of the sea portion 2 may each be a positive value or a negative value. For example, the average surface potential $V_1$ of the island portion 1 and the average surface potential $V_2$ of the sea portion 2 are each a negative value.

The surface potential difference ΔV can be measured, for example, by using a scanning probe microscope equipped with a probe (for example, a rhodium coated probe) to observe the surface of the carrier particles C in the KFM mode to obtain a potential image, and performing image analysis on the obtained potential image. The method of measuring the surface potential difference ΔV will be described later in detail in Examples.

The surface potential difference ΔV can be adjusted, for example, by changing the amount of the nitrogen-containing group of the nitrogen containing silicone resin that constitutes the island portion 1. The surface potential difference ΔV increases as the amount of the nitrogen-containing group of the nitrogen-containing silicone resin that constitutes the island portion 1 increases.

The island portion 1 may further contain a resin other than a nitrogen-containing silicone resin, but it is preferable that the island portion 1 contains only a nitrogen containing silicone resin in order to further suppress fogging occurring in a formed image. The sea portion 2 may further contain a resin other than the nitrogen-free silicone resin, but for the same reason, the sea portion 2 preferably contains only the nitrogen-free silicone resin. Also for the same reason, the island portion 1 and the sea portion 2 preferably contain no conductive material. In addition, since the acrylic resin tends to make it difficult to positively charge the toner, it is preferable that the island portion 1 and the sea portion 2 do not contain any acrylic resin in order to positively charge the toner favorably.

(Sea Portion of the Coat Layer)

As already mentioned, the sea portion 2 contains a nitrogen-free silicone resin. The nitrogen-free silicone resin may be, for example, a silicone resin having one or both of a methyl group and a phenyl group, an epoxy modified silicone resin, or a polyester modified silicone resin. The nitrogen-free silicone resin contained in the sea portion 2 preferably does not contain a nitrogen-containing group, and more preferably does not contain a nitrogen-containing group derived from an aminosilane coupling agent. The nitrogen-containing group will be described later. In the case of not having a nitrogen-containing group derived from an aminosilane coupling agent, the nitrogen-free silicone resin does not have an aminosilane coupling agent treated site.

(Island Portion of the Coat Layer)

As described above, the island portion 1 contains a nitrogen-containing silicone resin. The nitrogen-containing silicone resin contained in the island portion 1 preferably has at least one kind (for example, one kind or two kinds) of nitrogen-containing groups represented by chemical formulae (10), (11) and (12). That is, the nitrogen containing silicone resin preferably has at least one kind (for example, one or two kinds) of nitrogen-containing groups selected from the group consisting of a nitrogen-containing group represented by chemical formula (10), a nitrogen-containing group represented by chemical formula (11), and a nitrogen-containing group represented by chemical formula (12).

[Chemical formula 1]

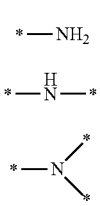

(10)

(11)

(12)

In chemical formulae (10), (11), and (12), * represents a bonding site bonded to an atom constituting a nitrogen-containing silicone resin. The atom to which this bonding site is bonded is preferably a carbon atom, more preferably a carbon atom constituting a group derived from an aminosilane coupling agent to be described later, and still more preferably a carbon atom constituting a group represented by general formula (1) or (4) to be described later. The nitrogen-containing group represented by chemical formula (10) is a monovalent group and an amino group. The nitrogen-containing group represented by chemical formula (11) is a two valent group. The two bonding sites in chemical formula (11) may be bonded to different atoms or to the same atom. The nitrogen containing group represented by chemical formula (12) is a three valent group. The three bonding sites in formula (12) may be bonded to different atoms. In addition, among the three bonding sites in the chemical formula (12), two bonding sites may be bonded to the same atom, and the remaining one bonding site may be bonded to a different atom.

The nitrogen-containing group is preferably a group derived from an aminosilane coupling agent. When having a nitrogen-containing group derived from an aminosilane coupling agent, the nitrogen-containing silicone resin has a site treated with an aminosilane coupling agent.

The nitrogen-containing silicone resin contained in the island portion 1 preferably has a group represented by general formula (1) or (4). The groups represented by general formulae (1) and (4) contain the nitrogen-containing group.

[Chemical formula 2]

(1)

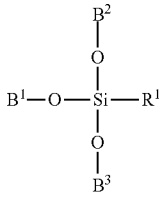

In general formula (1), $R^1$ represents a group represented by general formula (2) or (3). $B^1$ represents a bonding site bonded to a silicon atom constituting a nitrogen-containing silicone resin. $B^2$ and $B^3$ each independently represent a bonding site or a hydrogen atom bonded to a silicon atom constituting a nitrogen-containing silicone resin. Silicon atoms constituting the nitrogen-containing silicone resin are, for example, silicon atoms contained in the silicone main chain of the nitrogen-containing silicone resin or silicon atoms contained in the aminosilane coupling agent.

[Chemical formula 3]

(2)

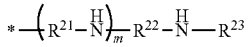

(3)

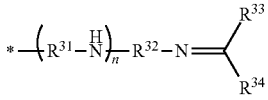

In general formula (2), $R^{21}$ and $R^{22}$ each independently represent an alkanediyl group having a carbon number of at, least 1 and 6 or less, which may be substituted with an amino group (—$NH_2$ group). $R^{23}$ represents an aryl group having a carbon number of at least 6 and 10 or less, a hydrogen atom, or an aralkyl group having a carbon number of at least 7 and 16 or less, which may be substituted with a vinyl group, m represents 0 or 1. In general formula (2), * represents a bonding site which is bonded to a silicon atom to which $R^1$ in general formula (1) is bonded.

In general formula (3), $R^{31}$ and $R^{32}$ each independently represent an alkanediyl group having a carbon number of at least 1 and 6 or less, which may be substituted with an amino group (—$NH_2$ group). $R^{33}$ and $R^{34}$ each independently represent an alkyl group having 1 or more and 6 or less carbon atoms, n represents 0 or 1. In general formula (3), * represents a bonding site bonded to the silicon atom to which $R^1$ in general formula (1) is bonded.

[Chemical formula 4]

(4)

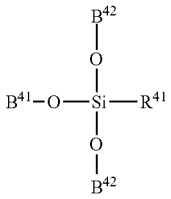

In general formula (4), $R^{41}$ represents a group represented by general formula (5). $R^{42}$ represents an alkyl group having a carbon number of at least 1 and 6 or less. $B^{41}$ represents a bonding site bonded to a silicon atom constituting a nitrogen-containing silicone resin. $B^{42}$ represents a bonding site bonded to a silicon atom constituting a nitrogen-containing silicone resin or a hydrogen atom.

(5)

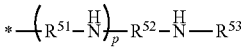

In general formula (5), $R^{51}$ and $R^{52}$ each independently represent an alkanediyl group having a carbon number of at least 1 and 6 or less, which may be substituted with an amino group. $R^{53}$ represents an aryl group having a carbon number of at least 6 and 10 or less, a hydrogen atom, or an aralkyl group having a carbon number of at least 7 and 16 or less, which may be substituted with a vinyl group. p represents 0 or 1. In general formula (5), * represents a bonding site which is bonded to a silicon atom to which $R^{41}$ in general formula (4) is bonded.

As the alkanediyl groups having 1 or more and 6 or less carbon atoms represented by $R^{21}$ and $R^{22}$ in general formula (2), $R^{31}$ and $R^{32}$ in general formula (3), and $R^{51}$ and $R^{52}$ in general formula (5), an alkanediyl group having 2 or more and 5 or less carbon atoms is preferable, and an ethanediyl group, a propandiyl group, or a pentanediyl group is more preferable. The alkanediyl group having a carbon number of at least 1 and no greater than 6 may be linear or branched. The alkanediyl group having a carbon number of at least 1 and no greater than 6 may be substituted with an amino group, and the alkanediyl group having a carbon number of at least 1 and no greater than 6 substituted with an amino group is preferably an alkanediyl group having a carbon number of at least 2 and no greater than 5 substituted with an amino group, and more preferably a 3-aminopentanediyl group.

The aryl groups having a carbon number of at least 6 and no greater than 10 represented by $R^{23}$ in general formula (2) and $R^{53}$ in general formula (5) are preferably phenyl groups.

The aralkyl group having a carbon number of at least 7 and no greater than 10 represented by $R^{23}$ in general formula (2) and $R^{53}$ in general formula (5) is preferably an aralkyl group having a carbon number of at least 7 and no greater than 9, and more preferably a benzyl group. The aralkyl group having a carbon number of at least 7 and no greater than 16 may be substituted with a vinyl group. The aralkyl group having a carbon number of at least 7 and no greater than 16 and substituted with a vinyl group is preferably an aralkyl group having a carbon number of at least 7 and no greater than 9 and substituted with a vinyl group, and more preferably a 4-vinylbenzyl group.

The alkyl group having a carbon number of at least 1 and no greater than 6 represented by $R^{33}$ and $R^{34}$ in general formula (3) and $R^{42}$ in general formula (4) is preferably an alkyl group having a carbon number of at least 1 and no greater than 4, and more preferably a methyl group or a butyl group. The alkyl group having a carbon number of at least 1 and no greater than 6 may be linear or branched.

Suitable examples of the group represented by general formula (1) include groups represented by the following general formulae (1-1) to (1-5): $B^1$, $B^2$, and $B^3$ in general formulae (1-1) to (1-5) have the same meanings as $B^1$, $B^2$, and $B^3$ in general formula (1), respectively. Preferable examples of the group represented by general formula (4) include a group represented by the following general formula (4-1): $B^{41}$ and $B^{42}$ in general formula (4-1) have the same meanings as $B^{41}$ and $B^{42}$ in general formula (4), respectively.

[Chemical formula 6]

(1-1)

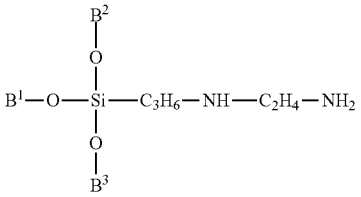

(1-2)

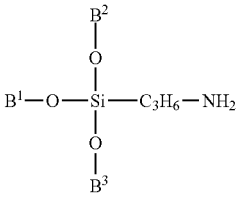

(1-3)

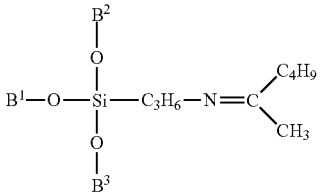

(1-4)

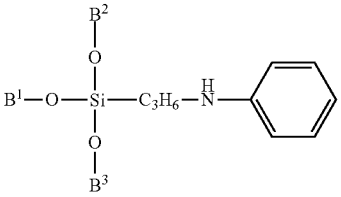

(1-5)

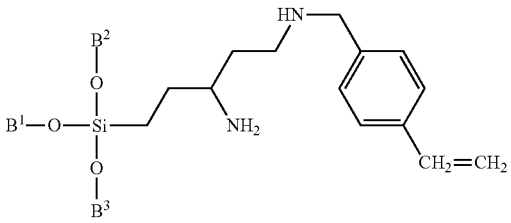

(4-1)

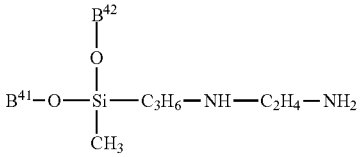

Examples of the aminosilane coupling agent capable of introducing a nitrogen-containing group into the silicone resin include N-2 (aminoethyl)-3-aminopropyltrimethoxysilane, 3-aminopropyltrimethoxysilane, 3-aminopropyltriethoxysilane, 3-triethoxysilyl-N-(1,3-dimethylbutylidene) propylamine, N-phenyl-3-aminopropyltrimethoxysilane, hydrochloride of N-(vinylbenzyl)-2-aminoethyl-3-aminopropyltrimethoxysilane, and N-2-(aminoethyl)-3-aminopropylmethyldimethoxysilane.

The group represented by general formula (1-1) is introduced into the silicone resin by N-2(aminoethyl)-3-aminopropyltrimethoxysilane. The group represented by general formula (1-2) is introduced into the silicone resin by any of 3-aminopropyltrimethoxysilane and 3-aminopropyltriethoxysilane. The group represented by the general formula (1-3) is introduced into the silicone resin by 3-triethoxysilyl-N-(1,3-dimethylbutylidene)propylamine. The group represented by the general formula (1-4) is introduced into the silicone resin by N-phenyl-3-aminopropyltrimethoxysilane. The group represented by the general formula (1-5) is introduced into the silicone resin by the hydrochloride of N-(vinylbenzyl)-2-aminoethyl-3-aminopropyltrimethoxysilane. The group represented by the general formula (4-1) is introduced into the silicone resin by N-2-(aminoethyl)-3-aminopropylmethyldimethoxysilane.

In the case of having a nitrogen-containing group derived from an aminosilane coupling agent, the nitrogen-containing silicone resin is preferably a silicone resin surface-treated with 120 parts by mass or more and 5000 parts by mass or less of the aminosilane coupling agent relative to 100 parts by mass of the silicone resin. In the case of having a nitrogen-containing group derived from an aminosilane coupling agent, the nitrogen-containing silicone resin is more preferably a silicone resin surface-treated with 360 parts by mass or more and 4600 parts by mass or less of the aminosilane coupling agent relative to 100 parts by mass of the silicone resin.

In order to obtain a carrier capable of favorably positively charging the toner, it is preferable that the nitrogen-containing silicone resin does not have an azide bond (—NCO group).

The $D_{50}$ of the first resin particles 101 constituting the island portion 1 is smaller than the $D_{50}$ of the carrier core 103. The $D_{50}$ of the first resin particles 101 is preferably not less than 50 nm and not more than 1000 nm, more preferably not less than 100 nm and not more than 500 nm.

(Carrier Core)

The carrier core 103 contained in the carrier particles C preferably contains a magnetic material. Examples of the magnetic material contained in the carrier core 103 include metal oxides, and more specifically, magnetite, maghemite, and ferrite. The carrier core 103 preferably contains ferrite. Examples of ferrite include barium ferrite, Mn—Zn ferrite, Ni—Zn ferrite, Mn—Mg ferrite, Mn—Mg—Sr ferrite, Ca—Mg ferrite, Li ferrite, and Cu—Zn ferrite. The $D_{50}$ of the carrier core 103 is preferably 5 μm or longer and 100 μm or shorter, and more preferably 20 μm or longer and 50 μm or shorter.

The coat layer 100 and the carrier core 103 of the carrier particles C may each contain additives as needed. The $D_{50}$ of the carrier particles C is preferably 5 μm or longer and 100 μm or shorter, and more preferably 20 μm or longer and 50 μm or shorter.

(Method for Manufacturing Carrier)

The method of manufacturing the carrier includes, for example, a step of forming the first resin particles 101 and a step of forming the coat layer 100.

In the step of forming the first resin particles 101, first resin particles 101 containing a nitrogen-containing silicone resin are produced. An example of the step of forming the first resin particles 101 will be described below. A toluene solution of a silicone resin, an aminosilane coupling agent, a catalyst, and a first surfactant are mixed to obtain a composition. Next, water and a second surfactant are added to the composition, and the composition is stirred while applying a high shearing force, thereby phase inversion emulsifying the composition from a W/O type to an O/W type to obtain an O/W type emulsion. The O/W type emulsion is heated to progress the crosslinking reaction of the silicone resin to obtain the suspension of the first resin particles 101. Suspensions of the first resin particles 101 are dried by hot air using a spray dryer to obtain the first resin particles 101.

The HLB value of the first surfactant is preferably lower than the HLB value of the second surfactant in order to suitably advance the phase inversion emulsification. The HLB value of the first surfactant is preferably 1 or more and 8 or less, more preferably 5 or more and 7 or less. The HLB value of the second surfactant is preferably 9 or more and 14 or less, and more preferably 12 or more and 14 or less. The sum of the HLB value of the first surfactant and the HLB value of the second surfactant is preferably 10 or more and 15 or less. The particle size of the resin particles can be adjusted by changing the ratio of the amount of the second surfactant to the amount of the first surfactant.

In the forming step of the coat layer 100, a coat layer 100 is formed on the surface of the carrier core 103 to obtain a carrier containing carrier particles C. An example of the step for forming the coat layer 100 will be described below. The liquid containing the first resin particles 101 obtained in the formation step of the resin particles, the nitrogen-free silicone resin, and toluene is sprayed to the carrier core 103 by using a rolling flow granulation coating apparatus and dried. Thus, on the surface of the carrier core 103, a coat layer 100 containing the first resin particles 101 and the nitrogen-free silicone resin is formed, and thereby the carrier particles C are obtained.

Second Embodiment: Developer

Figure 4:
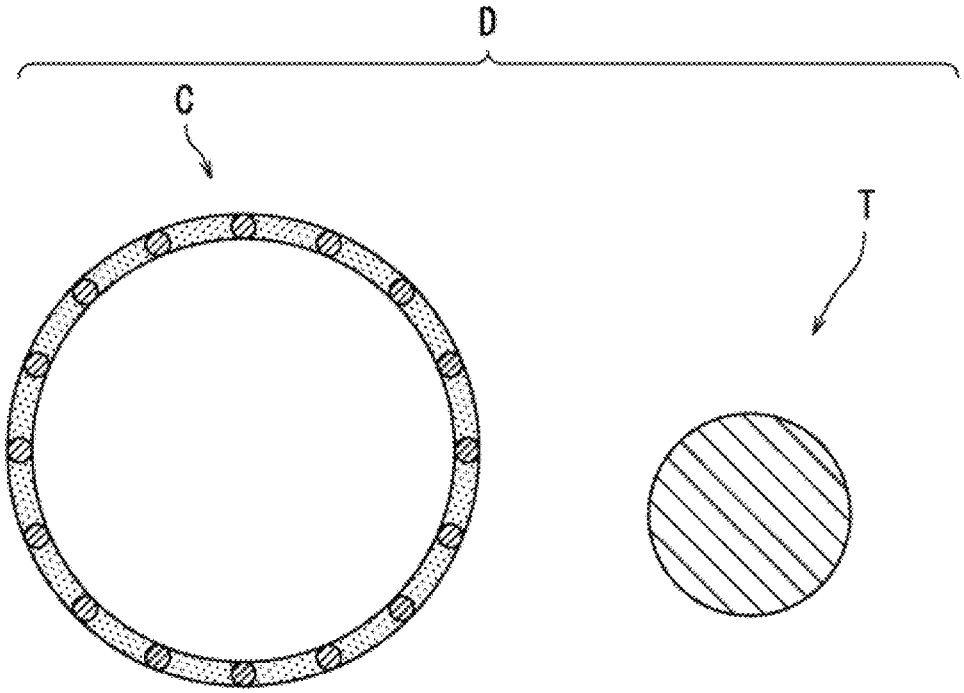
FIG. 4 is a view showing a developer according to a second embodiment of the present disclosure.

The developer D according to a second embodiment of the present disclosure will be described below with reference to FIG. 4. FIG. 4 is a diagram showing the developer D according to the second embodiment. The developer D shown in FIG. 4 contains toner (that is, the positively charged toner) containing toner particles T and a carrier containing carrier particles C. The carrier is a carrier according to the first embodiment. Since the carrier according to the first embodiment is contained, the developer D according to the second embodiment can suppress fogging occurring in the formed image for the same reason as described in the first embodiment.

The toner contained in the developer D will be described below. The toner contains toner particles T. The toner particles T have positive charging properties.

For ease of understanding, the toner particles T shown in FIG. 4 do not include external additive particles, but may include toner mother particles and external additive particles provided on the surface of the toner mother particles. In this case, the toner particles T shown in FIG. 4 correspond to the toner mother particles. The toner particles T shown in FIG. 4 do not have a shell layer, but may have a toner core and a shell layer covering the toner core. In this case, the toner particles T shown in FIG. 4 correspond to the toner core. The $D_{50}$ of the toner particles T is preferably 4 μm or more and 12 μm or less, and more preferably 5 μm or more and 9 μm or less.

The toner particles T contain, for example, a binder resin, a colorant, a charge control agent, and a release agent.

(Binder Resin)

Examples of the binder resin include a polyester resin, a styrene resin, an acrylate resin (more specifically, an acrylic acid ester polymer, a methacrylic acid ester polymer, etc.), an olefin resin (more specifically, polyethylene resin, polypropylene resin, etc.), a vinyl resin (more specifically, vinyl chloride resin, polyvinyl alcohol, vinyl ether resin, N-vinyl resin, etc.), a polyamide resin, and a urethane resin. A copolymer of these resins, that is, a copolymer in which an arbitrary repeating unit is introduced into the resin (more specifically, styrene-acrylic resins, styrene-butadiene resins, etc.) can also be used as a binder resin.

The binder resin is preferably a polyester resin. The polyester resin is a polymer of one or more polyvalent alcohol monomers and one or more polyvalent carboxylic acid monomers. Instead of the polyvalent carboxylic acid monomer, a polyvalent carboxylic acid derivative (more specifically, an anhydride of a polyvalent carboxylic acid, a polyvalent carboxylic acid halide, etc.) may be used.

Examples of the polyvalent alcohol monomer include diol monomers, bisphenol monomers, and trivalent or higher valent alcohol monomers.

Examples of diol monomers include ethylene glycol, diethylene glycol, triethylene glycol, 1,2-propanediol, 1,3-propanediol, 1,4-butanediol, neopentyl glycol, 2-butene-1, 4-diol, 1,5-pentanediol, 1,6-hexanediol, 1,4-cyclohexanedimethanol, 1,4-benzenediol, dipropylene glycol, polyethylene glycol, polypropylene glycol, and polytetramethyleneglycol.

Examples of bisphenol monomers include bisphenol A, hydrogenated bisphenol A, bisphenol A ethylene oxide adduct, and bisphenol A propylene oxide adduct.

Examples of trivalent or higher-valent alcohol monomers include sorbitol, 1,2,3,6-hexanetetrol, 1,4-sorbitan, pentaerythritol, dipentaerythritol, tripenlaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of the polyvalent carboxylic acid monomer include divalent carboxylic acid monomers and a trivalent or higher valent carboxylic acid monomers.

Examples of divalent carboxylic acid monomers include maleic acid, fumaric acid, citraconic acid, itaconic acid, glulaconic acid, phthalic acid, isophthalic acid, terephthalic acid, 5-sulfoisophthalic acid, sodium 5-sulfoisophthalate, cyclohexanedicarboxylic acid, adipic acid, sebacic acid, azelaic acid, malonic acid, succinic acid, alkylsuccinic acid, and alkenylsuccinic acid. Examples of alkylsuccinic acids include n-butylsuccinic acid, isobutylsuccinic acid, n-octylsuccinic acid, n-dodecylsuccinic acid, and isododecylsuccinic acid. Examples of alkenylsuccinic acid include n-butenylsuccinic acid, isobutenylsuccinic acid, n-octenylsuccinic acid, n-dodecenylsuccinic acid, and isododecenylsuccinic acid.

Examples of trivalent or higher valent carboxylic acid monomers include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxylic-2 methyl-2 methylenecarboxypropane, 1,2,4-cyclohexanetricarboxylic acid, tetra(methylenecarboxyl)methane, 1,2,7,8-octanetetracarboxylic acid, pyromellitic acid, and empol trimeric acid.

Tg of the polyester resin is preferably 60° C. or higher and 80° C. or lower. When two kinds of polyester resins are used, it is preferable that Tg of one polyester resin is 60° C. or higher and less than 65° C., and Tg of the other polyester resin is 65° C. or higher and 80° C. or lower.

Mw of the polyester resin is preferably 50,000 or more and 500,000 or less. When two kinds of polyester resins are used, it is preferable that Mw of one polyester resin is 50,000 or more and 100,000 or less, and Mw of the other polyester resin is 200,000 or more and 400,000 or less.

((Colorant))

As the colorant, a known pigment or dye can be used depending on the color of the toner. The amount of the colorant is preferably from 1 part by mass or more and 20 parts by mass or less relative to 100 parts by mass of the binder resin.

The toner particles T may contain a black colorant. Examples of the black colorant include carbon black. Also, the black colorant may be a colorant that has been colored in black using a yellow colorant, a magenta colorant, and a cyan colorant.

The toner particles T may contain a color colorant. Examples of the color colorant include a yellow colorant, a magenta colorant, and a cyan colorant.

The yellow colorants can include, for example, one or more compounds selected from the group consisting of condensed azo compounds, isoindolinone compounds, anthraquinone compounds, azo metal complexes, methine compounds, and arylamide compounds. Yellow colorants include, for example, C. I. Pigment Yellow (3, 12, 13, 14, 15, 17, 62, 74, 83, 93, 94, 95, 97, 109, 110, 111, 120, 127, 128, 129, 147 151, 154, 155, 168, 174, 175, 176, 180, 181, 191, and 194), Naphthol Yellow S, Hanza Yellow G, and C. I. Vat Yellow.

The magenta colorants can include, for example, one or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used. Examples of magenta colorants include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorants can include, for example, one or more compounds selected from the group consisting of copper phthalocyanine compounds, anthraquinone compounds, and basic dye lake compounds. Examples of cyan colorants include C. I. Pigment Blue (1, 7, 15, 15:1, 15:2, 15:3, 15:4, 60, 62, and 66), phthalocyanine blue, C. I. Vat Blue, and CC. I. Acid Blue.

(Charge Control Agent)

The charge control agent is used, for example, for the purpose of obtaining a toner excellent in charging stability and charging rising characteristic. The charging rising characteristic of the toner is an index of whether or not the toner can be charged to a predetermined charging level in a short time. However, in the case where sufficient charging property is ensured in the toner, it is not necessary to include the charge control agent in the toner particles T.

The charge control agent preferably includes a positive charge control agent. The positive charge control agent is a positive charge control agent. By adding a positive charge control agent (more specifically, pyridine, nigrosine dye, or a fourth grade ammonium salt or the like) to the toner particles T, the positive chargeability of the toner can he enhanced.

(Release Agent)

The release agent is used, for example, to obtain a toner excellent in hot offset resistance. The amount of the release agent is preferably from 1 part by mass or more and 20 parts by mass or more relative to 100 parts by mass of the binder resin.

Examples of the releasing agent include aliphatic hydrocarbon waxes, oxides of aliphatic hydrocarbon waxes, plant-derived waxes, animal-derived waxes, mineralogical waxes, ester waxes mainly composed of a fatty acid ester, and waxes obtained by deoxidizing a part or all of a fatty acid ester. Examples of the aliphatic hydrocarbon wax include polyethylene wax (for example, low molecular weight polyethylene), polypropylene wax (for example, low molecular weight polypropylene), polyolefin copolymer, polyolefin wax, microcrystalline wax, paraffin wax, and Fischer-Tropsch wax. Examples of the oxides of the aliphatic hydrocarbon wax include oxidized polyethylene wax and block copolymer of oxidized polyethylene wax. Plant-derived waxes include, for example, candeliila wax, carnauba wax, tree wax, jojoba wax, and rice wax. Animal-derived waxes include, for example, beeswax, lanolin, arid spermaceti wax. Mineralogical waxes include, for example, ozokerite, ceresin, and petrolatum. Examples of the ester wax include pentaerythritol ester wax, montanate ester wax, and custer wax. Examples of the wax in which a part or all of the fatty acid ester is deoxidized include deoxidized carnauba wax. As the releasing agent, ester wax is preferred, and pentaerythritol ester wax is more preferred. Mp of the releasing agent is preferably 60° C. or higher and 100° C. or lower, and more preferably 80° C. or higher and 90° C. or lower.

(External Additives)

When the toner particles T have an external additive containing external additive particles, the external additive is preferably an inorganic external additive. Examples of the inorganic external additive include silica and metal oxides (more specifically, alumina, titanium oxide, magnesium oxide, zinc oxide, strontium titanate, barium titanate, and the like). The amount of the external additive is preferably from 0.1 part by mass or more and 10 parts by mass or less relative to 100 parts by mass of the toner mother particles. The external additive may be surface treated. For example, when silica is used as another external additive, the surface of the silica may be given hydrophobicity and/or positive chargeability by a surface treatment agent.

(Method for Producing Developer)

The method for producing the developer D includes, for example, a process for producing a carrier, a process for producing a toner, and a process for mixing the carrier and the toner. The process for producing a carrier corresponds to the process for producing a carrier described in the first embodiment.

(Toner Manufacturing Process)

As an example of the process for producing a toner, a toner manufacturing process by a pulverization method will be described. In a toner manufacturing process, a binder resin, a colorant, a charge control agent, and a releasing agent are mixed to obtain a mixture. The mixture is kneaded while being melted to obtain a kneaded material. Examples of the melt kneader used for kneading include a single screw extruder, a two screw extruder, a roll mill, and an open-roll type kneader. The obtained kneaded material is pulverized to obtain a pulverized material. The pulverized material is classified to obtain a toner containing toner particles T. The obtained toner is a pulverized toner.

When the toner particles have toner mother particles and an external additive, an external additive process is further performed. In the external additive process, the toner mother particles corresponding to the toner particles T thus obtained are mixed with the external additive using a mixer. It is preferable that the mixing conditions are set such that the external additive is not completely buried in the toner mother particles. By the mixing, the external additive adheres to the surface of the toner mother particles and a toner is obtained. The external additive adheres to the surface of the toner mother particles not by chemical bonding but by physical bonding (physical force).

(Mixing Process of Carrier and Toner)

In the mixing process of the carrier and the toner, the toner and the carrier are mixed using a mixer (for example, a ball mill) to obtain developer D.

Third Embodiment: Image Forming Apparatus

Figure 5:
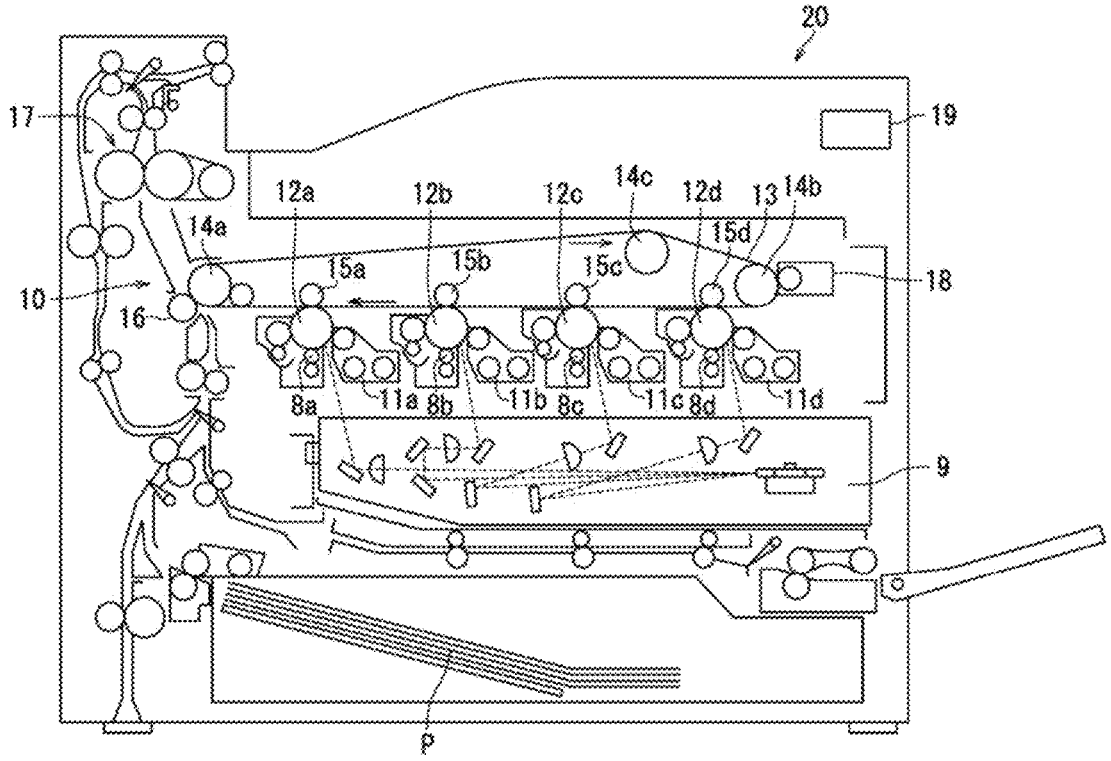
FIG. 5 is a diagram illustrating an image forming apparatus according to a third embodiment of the present disclosure.
Figure 6:
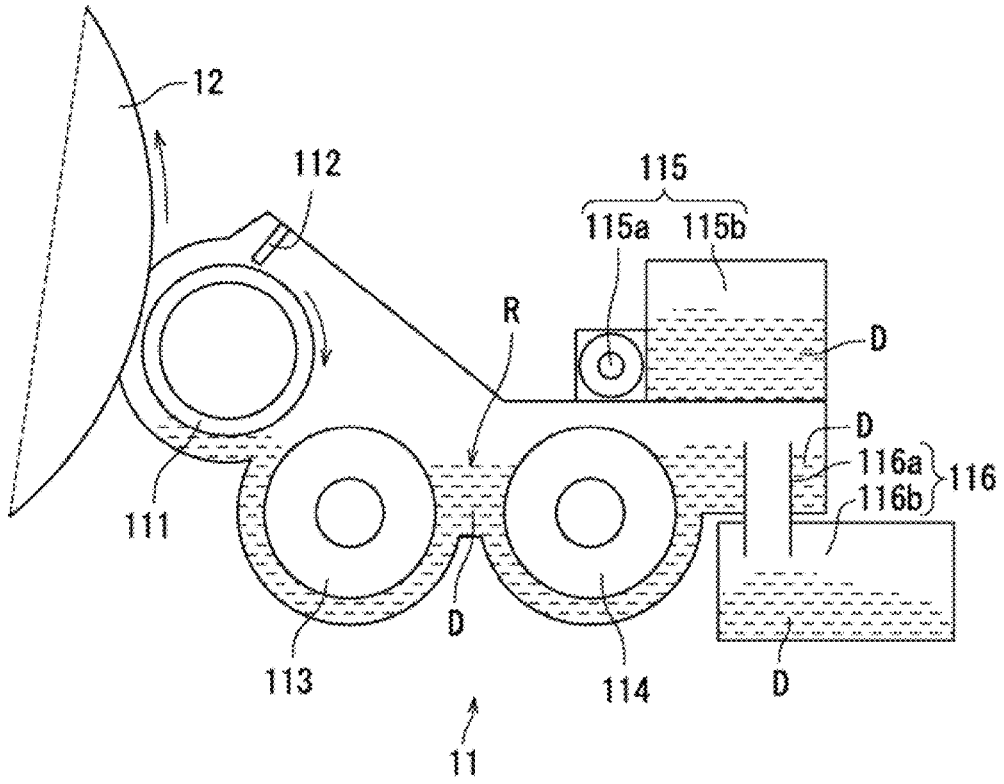
FIG. 6 is a view showing a developing device and its peripheral portion of the image forming apparatus shown in FIG. 5.

Next, referring to FIGS. 5 and 6, an image forming apparatus 20 according to a third embodiment of the present disclosure will be described. FIG. 5 shows a configuration of the image forming apparatus 20 according to the third embodiment. FIG. 6 shows developing devices 11*a* to 11*d* of the image forming apparatus 20 shown in FIG. 5 and the peripheral portions thereof. Hereinafter, each of the developing devices 11*a* to 11*d* is referred to as a developing device 11 when there is no need to distinguish them. The image forming apparatus 20 is an example of an image forming apparatus of a trickle developing method.

As shown in FIG. 6, the image forming apparatus 20 includes a developing device 11, a developer discharge unit 116, and a developer supply unit 115. The developing device 11 stores the developer D. The developing device 11 develops the electrostatic latent image with the developer D. The developer discharge unit 116 discharges the developer D in the developing device 11. The developer supply unit 115 supplies the developer D into the developing device 11. The developer D is the developer D described in the second embodiment, and it contains a toner containing toner particles T (that is, a positively chargeable toner) and a carrier according to the first embodiment. The developing device 11 of the image forming apparatus 20 according to the third embodiment accommodates the developer D containing the carrier according to the first embodiment. Therefore, for the same reason as described in the first embodiment, the image forming apparatus 20 according to the third embodiment can suppress fogging occurring in a formed image.

The image forming apparatus 20 shown in FIG. 5 adopts a tandem system. The image forming apparatus 20 includes charging devices 8*a* to 8*d*, an exposure device 9, developing devices 11*a* to 11*d*, photosensitive drums 12*a* to 12*d*, a transfer device 10, a fixing device 17, a cleaning device 18, and a control unit 19. The transfer device 10 includes a transfer belt 13, a driving roller 14*a*, a driven roller 14*b*, a tension roller 14*c*, primary transfer rollers 15*a* to 15*d*, and a secondary transfer roller 16. The transfer belt 13 is stretched around a driving roller 14*a*, a driven roller 14*b*, and a tension roller 14*c*. Hereinafter, when there is no need to distinguish, each of the charging devices 8*a* to 8*d* is described as the charging device 8, each of the photosensitive drums 12*a* to 12*d* is described as the photosensitive drum 12, and each of the primary transfer rollers 15*a* to 15*d* is described as the primary transfer roller 15.

The control unit 19 electronically controls the operation of the image forming apparatus 20 based on the outputs of the various sensors. The control unit 19 includes, for example, a central processing unit (CPU), a random access memory (RAM) and a storage device that stores a program, and rewritably stores predetermined data. The user gives an instruction (for example, an electric signal) to the control unit 19 through an input unit (not illustrated), and the input unit is for example, a keyboard, a mouse, or a touch panel.

The photosensitive drum 12 has a cylindrical outer shape and includes a metal cylindrical body (for example, a cylindrical conductive substrate) as a core material. A photosensitive layer is provided outside the core material. The photosensitive drum 12 is rotatably supported. The photosensitive drum 12 is driven by, for example, a motor (not shown) to rotate in a direction indicated by an arrow in FIG. 6.

The charging device 8 charges the circumferential surface of the photosensitive drum 12. The exposure device 9 exposes the charged circumferential surface of the photosensitive drum 12 to form an electrostatic latent image on the circumferential surface of the photosensitive drum 12. For example, an electrostatic latent image is formed on a surface layer portion (photosensitive layer) of the photosensitive drum 12 based on image data. The developing device 11 develops the electrostatic latent image formed on the photosensitive drum 12 with the developer D in the developing device 11. As a result, a toner image is formed on the circumferential surface of the photosensitive drum 12. Details of the developing device 11 will be described later.

The transfer belt 13 is driven by the driving roller 14*a* and rotates in a direction indicated by an arrow in FIG. 5. After the toner image is formed on the photosensitive drum 12, a bias (voltage) is applied to the primary transfer roller 15 to primarily transfer the toner (toner image) adhering to the photosensitive drum 12 onto the transfer belt 13. By sequentially primarily transferring the toner images formed on the plurality of photosensitive drums 12 onto the transfer belt 13, a plurality of types of toner images (for example, toner images of different colors) can be superimposed on the transfer belt 13. After the primary transfer, by applying a bias (voltage) to the secondary transfer roller 16, the toner image on the transfer belt 13 is secondarily transferred onto the recording medium P being conveyed. A plurality of types of toner images (for example, toner images of different colors) superimposed on the transfer belt 13 are collectively secondarily transferred onto the recording medium P. Thus, an image is formed on the recording medium P. The recording medium P is, for example, printing paper.

After the secondary transfer, the fixing device 17 heats and pressurizes the toner on the recording medium P to fix the toner on the recording medium P. The fixing device 17 includes, for example, a heating roller and a pressure roller. Such a fixing device 17 is called a nip fixing type fixing device 17. The fixing method is optional, and may be, for example, a belt fixing method. The cleaning device 18 removes toner remaining on the transfer belt 13 after the secondary transfer.

<Developing Device, Developer Supply Unit, and Developer Discharge Unit >

Next, with reference to FIG. 6, the developing device 11, the developer supply unit 115, and the developer discharge unit 116 will be described. The developing device 11 includes a developing roller 111, a regulating blade 112, a first stirring shaft 113, and a second stirring shaft 114. The developing device 11 has a storage portion R. The storage portion R houses the first stirring shaft 113 and the second stirring shaft 114. The developing roller 111 is arranged in the vicinity of the photosensitive drum 12.

The developing device 11 develops the electrostatic latent image by the developer D. The storage portion R stores therein the developer D. When the image forming apparatus 20 is used to form an image, the developer D is set in the developing device 11 (more specifically, the storage portion R provided in the developing device 11) and the developer supply unit 115 (developer container 115*b* provided with the developer supply unit 115). After the development of the electrostatic latent image by the developer D in the developing device 11 is started, the developer D in the developing device 11 is discharged and the developer D is supplied to the developing device 11. Therefore, when printing is continued by the image forming apparatus 20, the developer D in the storage portion R is gradually replaced with the new developer D supplied from the developer supply unit 115.

Each of the first stirring shaft 113 and the second stirring shaft 114 has a spiral stirring blade. The first stirring shaft 113 and the second stirring shaft 114 convey the developer D in the opposite directions to each other while stirring the developer D in the storage portion R. When the developer D containing the toner and the carrier is stirred, the toner is charged by friction with the carrier, and the charged toner is carried on the carrier.

The developing roller 111 includes a magnet roll and a developing sleeve. The magnet roll has magnetic poles at least on its surface layer part. The magnetic poles are, for example, an N-pole and an S-pole based on a permanent magnet. The developing sleeve is a nonmagnetic cylindrical body (For example, an aluminum pipe). The magnet roll is positioned in the developing sleeve (inside of cylinder), and the developing sleeve is positioned in the surface layer part of the developing roller 111. The shaft of the magnet roll and the developing sleeve are connected via a flange so that the developing sleeve can rotate around the non rotating magnet roll.

The developing roller 111 (specifically, the developing sleeve), while rotating in the direction of the arrow in FIG. 6, attracts the carrier in the storage portion R by magnetic force, and carries the developer D (carrier carrying toner) on the surface. The carrier particles C form a magnetic brush. The magnetic brush is a cluster of carrier particles C that are raised on the surface of the developing roller 111 (specifically, the developing sleeve). Toner particles T are adhered to the surface of the carrier particles C which are arranged in spikes. The thickness (ear height) of the magnetic brush is regulated to a predetermined thickness by the regulating blade 112.

As the developing roller 111 (Specifically, the developing sleeve) rotates in the direction of the arrow shown in FIG. 6, the toner of the developer D in the storage portion R is conveyed to the photosensitive drum 12. When a bias (voltage) is applied to the developing roller 111, a potential difference is generated between the surface potentials of the developing roller 111 and the photosensitive drum 12. By this potential difference, the charged toner contained in the developer D carried by the developing roller 111 moves to the surface of the photosensitive drum 12. Specifically, the charged toner in the developer D carried by the developing roller 111 is attracted to an electrostatic latent image (For example, an exposed portion having a potential lower than that of an unexposed portion due to exposure) formed on the photosensitive drum 12 by an electric force, and moves to the electrostatic latent image on the photosensitive drum 12. As a result, a toner image is formed on the surface of the photosensitive drum 12. During development of the electrostatic latent image, a magnetic brush on the developing roller 111 may contact the photosensitive drum 12. Alternatively, without bringing the magnetic brush into contact with the photosensitive drum 12, the toner may be made to fly from the developing roller 111 toward the photosensitive drum 12 by electric force.

Next, a supplying mechanism for supplying the developer D to the developing device 11 will be described. The developer supply unit 115 as a supplying mechanism supplies the developer D into the developing device 11. The developer supply unit 115 is provided on the upper part of the developing device 11. The developer supply unit 115 includes a developer container 115*b* and a supply amount adjusting member 115*a*. The developer container 115*b* stores the developer D. The developer D in the developer container 115*b* is supplied to the storage portion R of the developing device 11. The supply amount of the developer D supplied from the developer container 115*b* to the developing device 11 is controlled by the supply amount adjusting member 115*a*. The supply amount adjusting member 115*a* is formed o,. for example, a screw shaft whose rotational operation is controlled by the control unit 19. For example, the supply amount of the developer D can be changed in accordance with the rotation amount of the screw shaft. The developer container 115*b* may include a stirring device (not shown) for stirring the developer D in the developer container 115*b*.

Next, a discharge mechanism for discharging the developer D from the developing device 11 will be described. The developer discharge unit 116 as a discharge mechanism discharges the developer D in the developing device 11. The developer discharge unit 116 includes a discharge path 116*a* and a recovery container 116*b*. The storage portion R of the developing device 11 is connected to the recovery container 116*b* via the discharge path 116*a*. When the amount of the developer D in the storage portion R exceeds a predetermined amount, the excessive developer D enters the discharge path 116*a* through an opening on the upper end side of the discharge path 116*a*. The predetermined amount is, for example, an amount determined by the upper end position of the discharge path 116*a*. The excess developer D is, for example, the amount of developer D exceeding the amount determined by the upper end position of the discharge path 116*a*. When the excessive developer D enters the discharge path 116*a*, the excessive developer D moves downward inside the discharge path 116*a* by gravity and flows into the recovery container 116*b*.

As the images are formed on the recording medium P, the developer D in the developing device 11 contains toner having a poor charge, and toner particles T having a poor charge. The toner particles T with poor charging are toner particles T whose frictional charging amount is lower than the frictional charging amount when the toner particles T (Toner particles T stored in a developer container 115*b*) before being supplied into the developing device 11 are taken out from the developer container 115*b* and subjected to frictional charging by a carrier. As described in the first embodiment, when the developer D is discharged from the developing device 11, the toner particles T having a poor charge in the developing device 11 adhere to the islands 1 of the carrier particles C and are discharged from the developing device 11. As a result, the toner particles T having a poor charge do not remain in the developing device 11 for a long period of time, and fogging caused in the formed image due to the poor charging toner can be suppressed.

In order to suppress fogging occurring in the formed image, in the developer D stored in the developer container 115*b* (developer D before being supplied into the developing device 11), the content of the carrier is preferably 5 parts by mass or more with respect to 100 parts by mass of the toner. The upper limit of the content of the carrier is not particularly limited, but in the developer D stored in the developer container 115*b*, the content of the carrier is, for example, 20 parts by mass or less relative to 100 parts by mass of the toner.

In order to suppress fogging occurring in the formed image, in the developer D (initial developer D set in developing device 11) stored in the developing device 11 before the start of printing, the content of the carrier is preferably 80 parts by mass or more and 100 parts by mass or less relative to 10 parts by mass of the toner.

The image forming apparatus 20 according to the third embodiment has been described. The image forming apparatus according to the third embodiment is not limited to the above image forming apparatus 20, and can be changed, for example, as the first to fifth modifications shown below. In the first modification, the developer discharge unit 116 further includes a member (for example, a screw shaft) for adjusting the flow amount flowing from the storage portion R to the discharge path 116*a*. In the second modification, the developer discharge unit 116 further includes an opening and closing device that can change the opening area of the discharge port (for example, the opening on the upper end side of the discharge path 116*a*). In the third modification, a sensor for detecting the amount of the developer D in the storage portion R is provided in the storage portion R. In the fourth modification, a sensor for detecting the amount of the developer D discharged from the storage portion R is provided in the recovery container 116*b*. In the fifth modification, a developing roller other than the developing roller 111 (hereinafter sometimes referred to as the other developing roller) is further provided between the developing roller 111 and the photosensitive drum 12. The fifth modification corresponds to a touch down type image forming apparatus. In the image forming apparatus of the touch down method, for example, a potential difference is generated between the developing roller 111 and the other developing roller, so that only the toner out of the developer D (carrier and toner) carried on the surface of the developing roller 1 1 is moved to the other developing roller, and a toner layer is formed on the surface of the other developing roller. Then, the toner layer on the other developing roller is moved to the photosensitive drum 12, and the electrostatic latent image on the photosensitive drum 12 is developed into a toner image.

Fourth Embodiment: Image Forming Method

The image forming method according to the fourth embodiment of the present disclosure will be described with continued reference to FIGS. 5 and 6. The image forming method according to the fourth embodiment includes a developing step of developing the electrostatic latent image by using the developer D in the developing device 11 after the developing of the electrostatic latent image by the developer D in the developing device 11 is started, while the developer discharge unit 116 discharges the developer D from the developing device 11 and the developer supply unit 115 supplies the developer D to the developing device 11.

The image forming method according to the fourth embodiment is performed, for example, by using the image forming apparatus 20 according to the third embodiment. The image forming method according to the fourth embodiment is performed by using the developer D according to the second embodiment, that is, the developer D containing the toner containing the toner particles T (that is, the positively chargeable toner) and the carrier according to the first embodiment. Therefore, for the same reason as described in the first embodiment, according to the image forming method of the fourth embodiment, it is possible to suppress fogging occurring in the formed image.

EXAMPLES

Examples of the present disclosure will be described. In the evaluation in which an error occurs, a considerable number of measured values in which an error is sufficiently small were obtained, and the number average of the obtained measured values was used as an evaluation value. Also, in the following description, "room temperature" means 25° C., and "parts" means "parts by mass".

Table 1 shows the configurations of carriers (A-1) to (A-7) and (B-1) to (B-2) according to Examples or Comparative Examples.

TABLE 1

| | | Sea portion | | Island portion | | | | | |
|---|---|---|---|---|---|---|---|---|---|
| | | | Amount | Resin particles | | | Amount | Area ratio | ΔV |
| | Carrier | Resin | [parts] | Kind | Resin | N/S [parts] | [parts] | [%] | [V] |
| Example 1 | A-1 | Silicone S1 | 40.0 | A | Amino N1/ silicone S1 | 110.4/30.0 | 10.0 | 21 | 0.9 |
| Example 2 | A-2 | Silicone S1 | 30.0 | A | Amino N1/ silicone S1 | 110.4/30.0 | 20.0 | 40 | 0.9 |
| Example 3 | A-3 | Silicone S1 | 35.0 | C | Amino N1/ silicone S1 | 136.4/3.0 | 15.0 | 29 | 1.2 |
| Example 4 | A~4 | Silicone S2 | 35.0 | A | Amino N1/ silicone S1 | 110.4/30.0 | 15.0 | 30 | 0.9 |
| Example 5 | A~5 | Silicone S1 | 35.0 | D | Amino N1/ silicone S2 | 110.4/30.0 | 15.0 | 30 | 0.9 |
| Example 6 | A~6 | Silicone S3 | 35.0 | D | Amino N1/ silicone S2 | 110.4/30.0 | 15.0 | 29 | 0.9 |
| Example 7 | A~7 | Silicone S1 | 35.0 | E | Amino N2/ silicone S1 | 110.4/30.0 | 15.0 | 31 | 1.0 |

TABLE 1-continued

| | | Sea portion | | Island portion | | | | | |
|---|---|---|---|---|---|---|---|---|---|
| | | | Amount | Resin particles | | | Amount | Area ratio | ΔV |
| | Carrier | Resin | [parts] | Kind | Resin | N/S [parts] | [parts] | [%] | [V] |
| Comparative example 1 | B~1 | Silicone S1 | 42.5 | A | Amino N1/silicone S1 | 110.4/30.0 | 7.5 | 14 | 0.9 |
| Comparative example 2 | B~2 | Silicone S1 | 27.5 | A | Amino N1/silicone S1 | 110.4/30.0 | 22.5 | 46 | 0.9 |

In Table 1, the meanings of the terms are as follows.

Silicone S1: Silicone resin S1. The silicone resin S1 is a silicone resin contained in a silicone resin solution L-S1 ("KR-350" manufactured by Shin-Etsu Chemical Co., Ltd., solid concentration: 25 mass %, solvent: toluene).

Silicone S2: Silicone resin S2. The silicone resin S2 is a silicone resin contained in a silicone resin solution L-S2 ("KR-251" manufactured by Shin-Etsu Chemical Co., Ltd., solid concentration: 20 mass %, resin: a silicone resin having a methyl group, solvent: toluene).

Silicone S3: Silicone Resin S3. The silicone resin S3 is a silicone resin contained in a silicone resin solution L-S3 ("KR-300" manufactured by Shin-Etsu Chemical Co., Ltd., solid concentration: 50 mass %, resin: silicone resin having a methyl group and a phenyl group, solvent: xylene).

Amino N1: Aminosilane coupling agent N1 (N-2-(aminoethyl)-3-aminopropyltrimetboxysilane, "KBM-003" manufactured by Shin-Etsu Chemical Co., Ltd. Co., Ltd.)

Amino N2: Aminosilane coupling agent N2 (N-2-(aminoethyl)-3-aminopropylmethyldimethoxysilane, "KBM-602" manufactured by Shin-Etsu Chemical Co., Ltd. Co., Ltd.)

Amino N1/silicone S1: Silicone resin S1 treated with aminosilane coupling agent 1

Amino N1/silicone S2: Silicone resin S2 treated with aminosilane coupling agent N1

Amino N2/silicone S1: Silicone resin S1 treated with aminosilane coupling agent N2

N/S: mass of aminosilane coupling agent/mass of silicone resin

Area Ratio: The area ratio of islands in the total area of the surface of the carrier particle (unit %)

ΔV: surface potential difference ΔV which is a value calculated from "$|V_1-V_2|$" in Formula (A)

Hereinafter, a method for producing, measuring, and evaluating carriers (A-1) to (A-7) and (B-1) to (B-2) will be described.

[Method for Manufacturing Carrier]

<Production of Resin Particles>

First, resin particles A and C to E used to form the island portions of the carrier were produced.

(Production of Resin Particles A)

120.0 parts of a silicone resin solution L-S1 (solid content concentration: 25 mass %, amount of silicone resin S1: 30.0 parts), 9.6 parts of a catalyst (made by Shin-Etsu Chemical Co., Ltd. "CAT-AC"), and 110.4 parts of an aminosilane coupling agent N1 were mixed to obtain a solution I. To 240 parts of solution I was added 10 parts of ethylene glycol monohexyl ether (made by Tokyo Kasei Kogyo Co., Ltd. HLB value: 6.4) and mixed at room temperature to obtain the composition. 250 parts of the composition and 80 parts of polyoxyalkylene branched decyl ether (Daiichi Industrial Pharmaceutical Co., Ltd. "Neugen XL-80"; HLB value: 13.8) were placed in a 2 L volume vessel and mixed using a homomixer at a rotation speed of 4000 rpm for 1 minute. Then, 100 parts of ion-exchanged water were added into the vessel, and the mixture was kneaded with a homomixer at a rotational speed of 4000 rpm for 10 minutes to allow phase transition. 570 parts of ion-exchanged water were then added to the vessel and mixed using a homomixer at a rotational speed of 2500 rpm for 20 minutes to obtain emulsion II. The emulsion particles contained in emulsion II had an average particle diameter of 300 nm. The average particle size of the emulsified particles was the average particle size measured by a submicron particle size distribution measuring device (Made by Coulter Co., Ltd. "Colter N4 Plus") based on the Coulter principle. The resulting emulsion II was then heated with stirring at 80° C. for 12 hours to allow a portion of the silicone crosslinking reaction to proceed. As a result, emulsion III was obtained. Next, using a spray dryer (Made by Okawara Kako Co., Ltd. "FOC-25"), emulsion III was sprayed at a hot air temperature of 250° C. and dried to obtain resin particles A.

(Production of Resin Particles C)

Resin particles C were produced by the same method as resin particles A except that 120.0 parts of silicone resin solution L-S1 (solid content concentration: 25 mass %, amount of silicone resin S1: 30.0 parts), 9.6 parts of catalyst (made by Shin-Etsu Chemical Co., Ltd. "CAT-AC"), and 110.4 parts of aminosilane coupling agent N1 were changed to 12.0 parts of silicone resin solution L-S1 (solid content concentration: 25 mass %, amount of silicone resin S1: 3.0 parts), 9.6 parts of catalyst (Made by Shin-Etsu Chemical Co., Ltd. "CAT-AC"), 82.0 parts of toluene, and 136.4 parts of aminosilane coupling agent N1. 82.0 parts of toluene were added for concentration adjustment.

(Production of Resin Particles D)

Resin particles D were produced by the same method as resin particles A except that 120.0 parts of silicone resin solution L-S1 (solid content concentration: 25 mass %, amount of silicone resin S1: 30.0 parts), 9.6 parts of catalyst (made by Shin-Etsu Chemical Co., Ltd. "CAT-AC"), and 110.4 parts of aminosilane coupling agent N1 were changed to 150.0 parts of silicone resin solution L-S2 (solid content concentration: 20 mass %, amount of silicone resin S2: 30.0 parts), 9.6 parts of catalyst (made by Shin-Etsu Chemical Co., Ltd. "CAT-AC"), and 110.4 parts of aminosilane coupling agent N1.

(Production of Resin Particles E)

Resin particles E were produced by the same method as resin particles A except that 120.0 parts of silicone resin solution L-S1 (solid content concentration: 25 mass %, amount of silicone resin S1: 30.0 parts), 9.6 parts of catalyst (made by Shin-Etsu Chemical Co., Ltd. "CAT-AC"), and 110.4 parts of aminosilane coupling agent N1 were changed to 120.0 parts of silicone resin solution L-S1 (solid content concentration: 25 mass %, amount of silicone resin S1: 30.0 parts), 9.6 parts of catalyst (Made by Shin-Etsu Chemical Co., Ltd. "CAT-AC"), and 110.4 parts of aminosilane coupling agent N2.

<Manufacture of the Carrier>

(Manufacture of Carriers (A-1))

10.0 parts of the resin particles A and 80.0 parts of toluene were mixed to obtain a toluene dispersion of the resin particles A. To the toluene dispersion, 160.0 parts of a silicone resin solution L-S1 (solid content concentration: 25 mass %, amount of silicone resin S1: 40.0 parts) was added and further mixed to obtain a coating liquid (Solid concentration: 20 mass %).

Using a rolling fluid granulation coating apparatus (made by Pauleck Co., Ltd. "MP-01"), 1000 parts of a carrier core (Mn—Mg—Sr ferrite core. Powdertech Co., Ltd. "EF-35", particle size: 35 μm) were spray-coated with 100 parts of the coating liquid to obtain undried carrier particles. The undried carrier particles were dried in an oven at 250° C. for 1 hour to obtain a carrier (A-1) containing the carrier particles. In the production of the carrier (A-1), the island portions were formed by the resin particles A contained in the toluene dispersion, and the sea portion was formed by the silicone resin S1 contained in the silicone resin solution L-S1.

(Manufacture of Carriers (A-2))

The carrier (A-2) was produced in the same method as the carrier (A-1) except that instead of mixing 10.0 parts of the resin particles A and 80.0 parts of toluene, 20.0 parts of the resin particles A and 110.0 parts of toluene were mixed, and 160.0 parts of the silicone resin solution L-S1 (solid content concentration: 25 mass %, amount of silicone resin S1: 40.0 parts) was replaced with 120.0 parts of the silicone resin solution L-S1 (solid content concentration: 25 mass %, amount of silicone resin S1: 30.0 parts).

(Manufacture of Carriers (A-3))

The carrier (A-3) was produced by the same method as the carrier (A-1) except that instead of mixing 10.0 parts of resin particles A and 80.0 parts of toluene, 15.0 parts of resin particles C and 95.0 parts of toluene were mixed, and 160.0 parts of silicone resin solution L-S1 (solid content concentration: 25 mass %, amount of silicone resin S1: 40.0 parts) was replaced with 140.0 parts of silicone resin solution L-S1 (solid content concentration: 25 mass %, amount of silicone resin S1: 35.0 parts).

(Manufacture of Carriers (A-4))

The carrier (A-4) was produced by the same method as the carrier (A-1) except that instead of mixing 10.0 parts of the resin particles A and 80.0 parts of toluene, 15.0 parts of the resin particles A and 60.0 parts of toluene were mixed, and 160.0 parts of the silicone resin solution L-S1 (solid content concentration: 25 mass %, amount of silicone resin S1: 40.0 parts) was replaced with 175.0 parts of the silicone resin solution L-S2 (solid content concentration: 20 mass %, amount of silicone resin S2: 35.0 parts).

(Manufacture of Carriers (A-5))

The carrier (A-5) was produced by the same method as the carrier (A-1) except that instead of mixing 10.0 parts of the resin particles A and 80.0 parts of toluene, 15.0 parts of resin particles D and 95.0 parts of toluene were mixed, and 160.0 parts of silicone rosin solution L-S1 (solid content concentration: 25 mass %, amount of silicone resin S1: 40.0 parts) was replaced with 140.0 parts of silicone resin solution L-S1 (solid content concentration: 25 mass %, amount of silicone resin S1: 35.0 parts).

(Manufacture of Carriers (A-6))

The carrier (A-6) was produced by the same method as the carrier (A-1) except that instead of mixing 10.0 parts of resin particles A and 80.0 parts of toluene, 15.0 parts of resin particles D and 165.0 parts of toluene were mixed, and 160.0 parts of silicone resin solution L-S1 (solid content concentration: 25 mass %, amount of silicone resin S1: 40.0 parts) was replaced with 70.0 parts of silicone resin solution L-S3 (solid content concentration: 50 mass %, amount of silicone resin S3: 35.0 parts).

(Manufacture of Carriers (A-7))

The carrier (A-7) was produced by the same method as the carrier (A-1) except that instead of mixing 10.0 parts of resin particles A and 80.0 parts of toluene, 15.0 parts of resin particles E and 95.0 parts of toluene were mixed, and 160.0 parts of silicone resin solution L-S1 (solid content concentration: 25 mass %, amount of silicone resin S1: 40.0 parts) was replaced with 140.0 parts of silicone resin solution L-S1 (solid content concentration: 25 mass %, amount of silicone resin S1: 35.0 parts).

(Manufacture of Carriers (B-1))

The carrier (B-1) was produced by the same method as the carrier (A-1) except that instead of mixing 10.0 parts of the resin particles A and 80.0 parts of toluene, 7.5 parts of the resin particles A and 72.5 parts of toluene were mixed, and 160.0 parts of the silicone resin solution L-S1 (solid content concentration: 25 mass %, amount of silicone resin S1: 40.0 parts) was replaced with 170.0 parts of the silicone resin solution L-S1 (solid content concentration: 25 mass %, amount of silicone resin S1: 42.5 parts).

(Manufacture of Carriers (B-2))

The carrier (B-2) was produced by the same method as the carrier (A-1) except that instead of mixing 10.0 parts of the resin particles A and 80.0 parts of toluene, 22.5 parts of the resin particles A and 117.5 parts of toluene were mixed, and 160.0 parts of the silicone resin solution L-S1 (solid content concentration: 25 mass %, amount of silicone resin S1: 40.0 parts) was replaced with 110.0 parts of the silicone resin solution L-S1 (solid content concentration: 25 mass %, amount of silicone resin S1: 27.5 parts).

The solid content concentration of the coating liquid produced in the process for producing the carriers (A-1) to (A-7) and (B-1) to (B-2) was 20 mass %.

[Measuring Method of Carrier]

<Confirmation of Sea-Island Structure, Measurement of Surface Potential Difference ΔV, and Measurement of the Area Ratio of Island Portion>

Using an SPM probe station ("NanoNaviReal" by Hitachi High-Tech Science Co., Ltd.) equipped with a scanning probe microscope (SPM, a multifunctional unit "AFM 5200 S" manufactured by Hitachi High-Tech Science Corporation), the surfaces of the carrier particles were observed under the following measurement conditions, and potential images of the surface of the carrier particles were obtained. The obtained potential images were composed of dots having luminance of 0 to 255 in 256 gradation. Each of the 256 gradations of luminance corresponded to a potential obtained by dividing a range from the minimum value to the maximum value of the measured surface potential of the carrier particles into 256. In the potential images, the higher the absolute value of the potential, the higher the luminance of the dot. The surfaces of the 10 carrier particles contained in the carrier was observed to obtain 10 potential images. By image analysis of 10 potential images, a histogram in which the luminance of dots was taken on the horizontal axis and the number of dots having corresponding luminance was taken on the vertical axis was obtained.

(Measurement Condition)

Movable range of the measuring unit (Range corresponding to the size of the measurable sample): 100 μm (Small Unit)

Measuring probe: Rhodium-Coated probe ("SI-DF-3 R" by Hitachi High-Tech Science Co., Ltd.)

Measurement mode: Kelvin Force Microscope (KFM)

Excitation voltage: 1 V

Measurement range (range equivalent to one field): 1 μm×1 μm

Resolution (X Data/Y Data): 256/256

With reference to FIG. 3, it was confirmed whether or not sea portions and island portions as described in the first embodiment exist in the obtained potential image.

Figure 7:
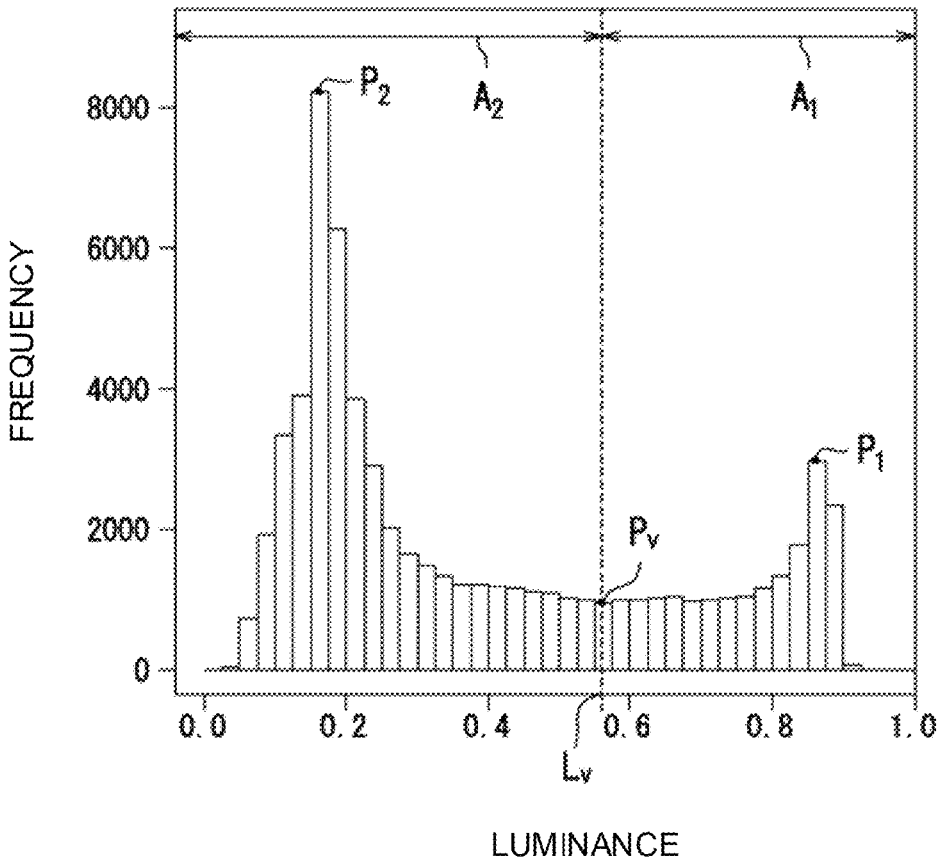
FIG. 7 is a view showing a histogram obtained from a potential image of the surface of the carrier particle contained in the carrier (A-3).

The calculation method of the surface potential difference ΔV and the area ratio of the island portion will be described below with reference to FIG. 7. FIG. 7 shows a histogram obtained from potential images of the surfaces of 10 carrier particles contained in carriers (A-3). In FIG. 7, the horizontal axis indicates the luminance of the dots of the potential image, and the vertical axis indicates the frequency (Frequency) of the number of dots having the corresponding luminance. In the histogram shown in FIG. 7, 2 peaks $P_1$ and $P_2$ and a valley portion $P_V$ having the lowest value of the vertical axis between the 2 peaks $P_1$ and $P_2$ (be least frequent) were confirmed. When a plurality of valley portions $P_V$ are confirmed, the valley portion $P_V$ having a luminance closest to an intermediate value (number mean value) between the luminance of the peak $P_1$ and the luminance of the peak $P_2$ is determined as the valley portion $P_V$. The luminance of the peak $P_1$ is higher than the luminance of the peak $P_2$. A region having a potential equal to or higher than the luminance $L_V$ of the valley portion $P_V$ is defined as a first region $A_1$. A region having a potential lower than the luminance $L_V$ of the valley portion $P_V$ is defined as a second region $A_2$. The peak $P_1$ was located in the first region $A_1$, and the peak $P_2$ was located in the second region $A_2$. The number-average potential of the dots belonging to the first region $A_1$ is calculated from the potential of each dot belonging to the first region $A_1$ and the number of dots, and the number-average potential of the dots belonging to the first region $A_1$ is set as the average surface potential $V_1$ (units: V) of the island portions. The number-average potential of the dots belonging to the second region $A_2$ is calculated from the potential of each dot belonging to the second region $A_2$ and the number of dots, and the number-average potential of the dots belonging to the second region $A_2$ is set to the average surface potential $V_2$ (units: V) of the sea portions. Then, the surface potential difference ΔV was calculated according to the following equation.

$$\text{Surface potential difference } \Delta V = |V_1 - V_2|$$

From the number of dots belonging to the first region $A_1$ and the number of dots belonging to the second region $A_2$, the area ratio (units: %) of the island portions was calculated according to the equation (B).

$$\text{Area ratio of island portions} = 100 \times (\text{Number of dots belonging to the first area } A_1)/[(\text{Number of dots belonging to the first area } A_1) + (\text{Number of dots belonging to the second area } A_2)] \quad \text{(B)}$$

The obtained surface potential differences ΔV and the area ratios of the island portions are shown in Table 1. In the potential images of any of the carriers (A-1) to (A-7), sea portions and island portions were confirmed. In addition, in any of the carriers (A-1) to (A-7), the average surface potential $V_1$ of the island portions and the average surface potential $V_2$ of the sea portions were negative values, respectively.

[Career Evaluation Methods]

<Preparation of Developers for Use in Evaluation>

10 parts by mass of the toner and 90 parts by mass of the carrier were mixed to obtain an initial developer. Further, 900 parts by mass of the toner and 15 parts by mass of the carrier were mixed to obtain a replenishing developer. In the replenishing developer, the content of the carrier was 5 parts by mass relative to 100 parts by mass of the toner. The toner contained in each of the initial developer and the replenishing developer were produced by the following method.

(Manufacture of Toner)

First, toner base particles were prepared. Specifically, an FM mixer ("FM-10" manufactured by NIPPON COKE & ENGINEERING CO., LTD.) was used to mix 48.0 parts by mass of a first polyester resin (Mw: 300000, Tg: 65° C.), 39.0 parts by mass of a second polyester resin (Mw: 75000, Tg: 61° C.), 8.0 parts by mass of carbon black ("MA 100" manufactured by Mitsubishi Chemical Corporation), 2.0 parts by mass of a charge control agent (Nigrosine dye, "BONTRON (registered trademark) N-71" manufactured by Orient Chemical Industry Co., Ltd.), and 3.0 parts by mass of a release agent ("Nissan Elektor (registered trademark) WEP-5" manufactured by NOF CORPORATION), an ingredient: pentaerythritol behenic acid ester wax, and a melting temperature: 84° C.). Using a 2 screw extruder ("TEM-26SS" manufactured by Toshiba Machine Co., Ltd.), the obtained mixture was melt kneaded to obtain a kneaded product. The kneaded product was cooled. The cooled kneaded product was coarsely pulverized using a pulverizer ("ROTOPLEX (registered Japanese trademark) Model 16/8" manufactured by Toagosei Co., Ltd.) under the set conditions of a grain size of 2 mm to obtain a coarsely pulverized product. The coarsely pulverized product was finely pulverized using a pulverizer ("Turbo Mill Model RS" manufactured by Freund Turbo Corporation) to obtain a finely pulverized product. The finely pulverized product was classified using a classifier ("Elbow Jet EJ-LABO" manufactured by Nittetsu Mining Co., Ltd.) to obtain toner mother particles. The $D_{50}$ of the toner mother particles was 7.0 μm.

An external additive was externally added to the obtained toner mother particles. Specifically, using an FM mixer (made by Japan Coke Industry Co., Ltd. "FM-10") under the condition of a rotation speed of 3500 rpm, 100.0 parts by mass of the toner mother particles, 1.5 parts by mass of the positively charged silica particles (Dry type silica particles with positive charge property imparted by surface treatment, "AEROSIL (registered trademark) REA 200" manufactured by Nippon Aerosil Co., Ltd., number average primary particle size: 13 nm), and 1.0 parts by mass of the titanium oxide particles ("MT-500 B" manufactured by Teika Limited, content: untreated titanium oxide particles, number-average primary particle size: 35 nm) were mixed for 5 minutes. By mixing, positively charged silica particles and titanium oxide particles adhered to the surfaces of the toner mother particles. Thereafter, the toner mother particles to which the external additive adhered were sieved using a sieve of 300 meshes (Opening 48 μm) to obtain toner. The obtained toner has positive charging property.

<Evaluation of Fog Concentration>

A color multifunction device ("TASKalfa 2553 ci" manufactured by Kyocera Document Solutions Co., Ltd., development method: trickle development method) was used as the evaluation machine. The evaluation machine includes a developing device, a developer discharge unit, and a developer supply unit. The initial developer produced in <Preparation of developers for use in evaluation> was charged into the black developing device of the evaluation machine. The replenishing developer produced in the above <Preparation of developers for use in evaluation> was charged into the developer container of the black developer supply section of the evaluation machine.

A blank image was printed on 1000 sheets of paper using the evaluation machine in an environment of a temperature of 32.5° C. and a humidity of 80% RH. Next, a character pattern image (print ratio of 10%) was printed on 100 sheets of paper using the evaluation machine. The fog density (FD) was measured for the one hundredth sheet on which the character pattern image was printed. In the measurement of FD, a reflection densitometer ("SpectroEye (registered trademark)" manufactured by X-Rite, Inc.) was used to measure the reflection density of a blank portion of the sheet on which the image was printed. Then, the FD was calculated based on the formula "FD=reflection density of blank area reflection density of unprinted paper". The measurement results of the FD are shown in Table 2. The lower the FD is, the more suppressed the fogging that occurs in the formed image.

TABLE 2

| | Carrier | Evaluation FD |
|---|---|---|
| Example 1 | A-1 | 0.003 |
| Example 2 | A-2 | 0.003 |
| Example 3 | A-3 | 0.002 |
| Example 4 | A-4 | 0.003 |
| Example 5 | A-5 | 0.003 |
| Example 6 | A-6 | 0.003 |
| Example 7 | A-7 | 0.002 |
| Comparative example 1 | B-1 | 0.007 |
| Comparative example 2 | B-2 | 0.008 |

As shown in Table 1, each of the carriers (A-1) to (A-7) had the following constitutions. The carrier particles had a sea island structure including the sea portion and the island portions on the surface thereof. The island portions contained the nitrogen-containing silicone resin (more specifically, the silicone resin S1 treated with the aminosilane coupling agent N1, the silicone resin S2 treated with the aminosilane coupling agent N1, or the silicone resin S1 treated with an aminosilane coupling agent N2). The sea portion contained a nitrogen-free silicone resin (more specifically, silicone resins S1, S2, or S3). The area ratio of the island portions in the total area of the surfaces of the carrier particles was 20% or more and 40% or less. Therefore, as shown in Table 2, the FD of the image printed using the developer containing the carriers (A-1) to (A-7) was lower than the FD of the image printed using the developer containing the carriers (B-1) to (B-2), and the fog occurring in the formed image was suppressed.

From the above, it is judged that the carrier according to the present disclosure and the developer according to the present disclosure can suppress fogging occurring in a formed image. Also, it is judged that the image forming apparatus and the image forming method according to the present disclosure can suppress fogging occurring in a formed image because such a developer containing a carrier is used.

What is claimed is:

1. A carrier for a developer comprising: carrier particles, wherein the carrier particle has a sea-island structure including a sea portion and an island portion on a surface thereof, the island portion contains a nitrogen-containing silicone resin, the sea portion contains a nitrogen-free silicone resin, and an area ratio of the island portion to a total area of the surfaces of the carrier particle is 20% or more and 40% or less.

2. The developer carrier according to claim 1, wherein the nitrogen-containing silicone resin has at least one of nitrogen-containing groups represented by the following chemical formulae (10), (11), and (12)

[Chemical formula 1]

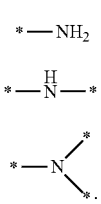

(10)

(11)

(12)

3. The carrier for a developer according to claim 2, wherein the nitrogen-containing group is a group derived from an aminosilane coupling agent.

4. The developer carrier according to claim 1, wherein the nitrogen-containing silicone resin has a group represented by the following general formula (1):

[Chemical formula 2]

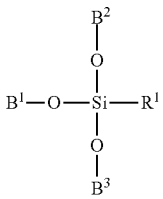

(1)

$R^1$ represents a group represented by the following general formula (2) or (3)

$B^1$ represents a bonding site bonded to a silicon atom constituting the nitrogen containing silicon resin, and $B_2$ and $B_3$ each independently represent a bonding site bonded to a silicon atom constituting the nitrogen-containing silicone resin, or hydrogen atoms)

[Chemical formula 3]

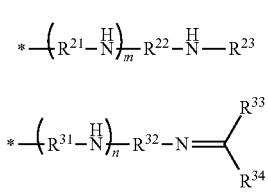

(2)

(3)

(in the general formula (2). $R^{21}$ and $R^{22}$ each independently represent an alkanediyl group having a carbon number of at least 1 and no greater than 6 that may be substituted with amino groups, $R^{23}$ represents an aryl group having a carbon number of at least 6 and no greater than 10, hydrogen atoms, or an aralkyl group having a carbon number of at least 7 and no greater than 16 that may be substituted with vinyl groups, and m represents 0 or 1, in general formula (3), $R^{31}$ and $R^{32}$ each independently represent an alkanediyl group having a carbon number of at least 1 and no greater than 6 that may be substituted with amino groups, $R^{33}$ and $R^{34}$ each independently represent an alkyl group having a carbon number of at least 1 and no greater than 6, and n represents 0 or 1).

5. The carrier for a developer according to claim 1, wherein the nitrogen-containing silicone resin has a group represented by the following general formula (4):

[Chemical formula 4]

(4)

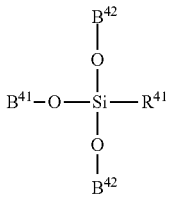

(In the general formula (4), $R^{41}$ represents a group represented by the following general formula (5), $R^{42}$ represents an alkyl group having a carbon number of at least 1 and no greater than 6, $B^{41}$ represents a bonding site bonded to a silicon atom constituting the nitrogen-containing silicone resin; and $B^{42}$ represents a bonding site bonded to a silicon atom constituting the nitrogen-containing silicone resin or hydrogen atoms)

[Chemical formula 5]

(5)

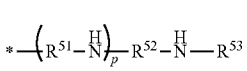

(in general Formula (5), $R^{51}$ and $R^{52}$ each independently represent an alkanediyl group having a carbon number of at least 1 and no greater than 6 that may be substituted with amino groups, $R^{53}$ represents an aryl group having a carbon number of at least 6 and no greater than 10, hydrogen atoms, or an aralkyl group having a carbon number of at least 7 and no greater than 16 that may be substituted with vinyl groups, and p represents 0 or 1).

6. A developer comprising:

a positively chargeable toner containing toner particles; and the carrier for a developer according to claim 1.

* * * * *